US009771744B2

(12) United States Patent
Yang

(10) Patent No.: US 9,771,744 B2
(45) Date of Patent: Sep. 26, 2017

(54) GLOVE BOX FOR VEHICLE

(71) Applicant: HYUNDAI MOBIS Co., Ltd., Yongin-si, Gyeonggi-do (KR)

(72) Inventor: Kil Seok Yang, Yongin-si (KR)

(73) Assignee: HYUNDAI MOBIS CO., LTD., Yongin-si, Gyeonggi-do (KR)

( * ) Notice: Subject to any disclaimer, the term of this patent is extended or adjusted under 35 U.S.C. 154(b) by 281 days.

(21) Appl. No.: 14/524,011

(22) Filed: Oct. 27, 2014

(65) Prior Publication Data

US 2015/0130194 A1 May 14, 2015

(30) Foreign Application Priority Data

Nov. 12, 2013 (KR) ..... 10-2013-0137191

(51) Int. Cl.

| | |
|---|---|
| ***E05C 1/06*** | (2006.01) |
| ***E05B 83/30*** | (2014.01) |
| ***E05C 9/04*** | (2006.01) |

(52) U.S. Cl.

CPC ..... *E05B 83/30* (2013.01); *E05C 9/041* (2013.01); *Y10T 292/1014* (2015.04)

(58) Field of Classification Search

CPC ..... E05B 83/30

See application file for complete search history.

(56) References Cited

U.S. PATENT DOCUMENTS

| | | | |
|---|---|---|---|
| 8,590,351 | B2 | 11/2013 | Ookawara et al. |
| 2006/0055196 | A1 | 3/2006 | Yamada |
| 2008/0022730 | A1 | 1/2008 | Dietrich et al. |

FOREIGN PATENT DOCUMENTS

| | | | |
|---|---|---|---|
| DE | 103 54 645 | B3 | 2/2005 |

OTHER PUBLICATIONS

Dec. 17, 2015, German Office Action for related DE application No. 102014116407.5.

*Primary Examiner* — Mark Williams

(74) *Attorney, Agent, or Firm* — Paratus Law Group, PLLC

(57) ABSTRACT

A glove box for a vehicle according to the present invention includes: a push rod housing which is fixed to a glove box door; a push rod which is slidably disposed in the push rod housing in order to lock or unlock the glove box door; and a guide rod which is coupled to the push rod, and moved along an outer surface of the push rod housing when the push rod slides, such that when a user presses the knob, the knob is operated without rattling.

12 Claims, 9 Drawing Sheets

GLOVE BOX FOR VEHICLE

CROSS-REFERENCE TO RELATED APPLICATIONS

The present application claims priority to Korean Patent Application Number 10-2013-0137191 filed Nov. 12, 2013, the entire contents of which the application is incorporated herein for all purposes by this reference.

TECHNICAL FIELD

The present invention relates to a glove box for a vehicle, and more particularly, to a locking device for an accommodating box for a vehicle, which unlocks the accommodating box in a push manner.

BACKGROUND

In general, a glove box, which may accommodate articles, is disposed in an instrument panel in a vehicle. Typically, the glove box is disposed in front of a front passenger seat.

The glove box includes a glove box housing which is fixedly installed in the instrument panel, and a glove box door which is hingedly coupled to the glove box housing, and opened and closed by a manipulation of a user, thereby accommodating articles in the glove box door.

Meanwhile, a locking unit, which locks or unlocks the glove box door with respect to the glove box housing, is disposed in the glove box. The locking unit is disposed in the glove box door, and has a structure in which the glove box door is locked when a rod, which protrudes from the glove box door, is inserted into the glove box housing, and the glove box door is unlocked when the rod comes out of the glove box housing.

Recently, a dual rod type locking unit, which has two rods connected with a knob or a button, is installed in the glove box door. In this case, both sides of the glove box are locked by the respective rods, and both sides of the glove box are unlocked by allowing the respective rods to slide at the same time by pulling and rotating the knob or pressing the button, thereby preventing the glove box door from being easily opened toward the interior of the vehicle at the time of a vehicle accident, and improving safety for the occupants. Here, a device, which unlocks the glove box by pulling and rotating the knob, is called a pull type locking device, and a device, which unlocks the glove box by pressing the button, is called a push type locking device.

SUMMARY

The present invention has been made in an effort to provide a glove box for a vehicle, in which when a user presses a knob, the knob is operated without shaking.

Technical problems of the present invention are not limited to the aforementioned technical problem, and other technical problems, which are not mentioned above, may be clearly understood by those skilled in the art from the following descriptions.

An exemplary embodiment of the present invention provides a glove box for a vehicle, including: a push rod housing which is fixed to a glove box door; a push rod which is slidably disposed in the push rod housing in order to lock or unlock the glove box door; and a guide rod which is coupled to the push rod, and moved along an outer surface of the push rod housing when the push rod slides.

Another exemplary embodiment of the present invention provides a glove box for a vehicle, including: a push rod housing which is fixed to a glove box door; and a push rod which is slidably disposed in the push rod housing in order to lock or unlock the glove box door, in which a protruding portion is formed on any one of the push rod housing and the push rod, and a groove into which the protruding portion is inserted is formed in the other one of the push rod housing and the push rod, such that when the push rod slides, the push rod slides while being guided by the protruding portion and the groove.

Other detailed matters of the exemplary embodiment are included in the detailed description and the drawings.

According to the glove box for a vehicle according to the present invention, the knob may be operated without shaking when the user presses the knob, and the knob may also be prevented from rattling due to vibration of the vehicle when the vehicle travels.

The effect of the present invention is not limited to the aforementioned effect, and other effects, which are not mentioned above, will be clearly understood by those skilled in the art from the claims.

DETAILED DESCRIPTION

Figure 1:
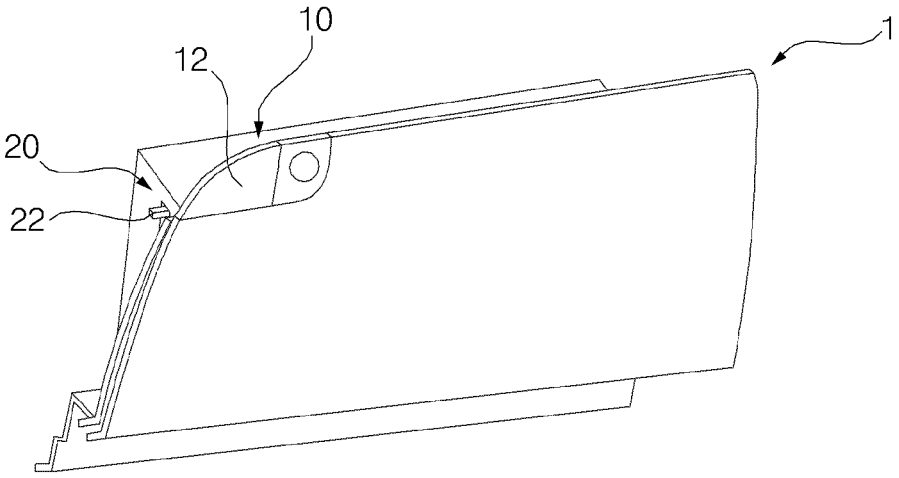
FIG. 1 is a front perspective view illustrating a glove box door of a glove box for a vehicle according to an exemplary embodiment of the present invention.

Advantages and features of the present invention and methods of achieving the advantages and features will be clear with reference to an exemplary embodiment described in detail below together with the accompanying drawings. However, the present invention is not limited to the exemplary embodiment set forth below, and may be embodied in various other forms. The present exemplary embodiment is for rendering the disclosure of the present invention complete and is set forth to provide a complete understanding of the scope of the invention to a person with ordinary skill in the technical field to which the present invention pertains, and the present invention will only be defined by the scope of the claims. Like reference numerals indicate like elements throughout the specification.

Hereinafter, a locking device for a glove box for a vehicle according to an exemplary embodiment of the present invention will be described with reference to the drawings.

Figure 2:
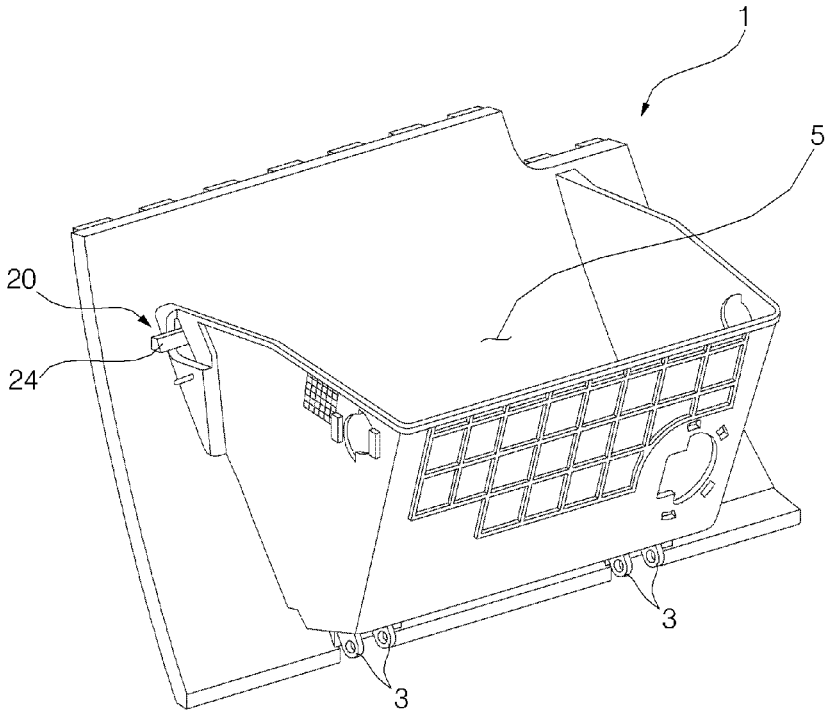
FIG. 2 is a rear perspective view illustrating the glove box door of the glove box for a vehicle according to the exemplary embodiment of the present invention.
Figure 3:
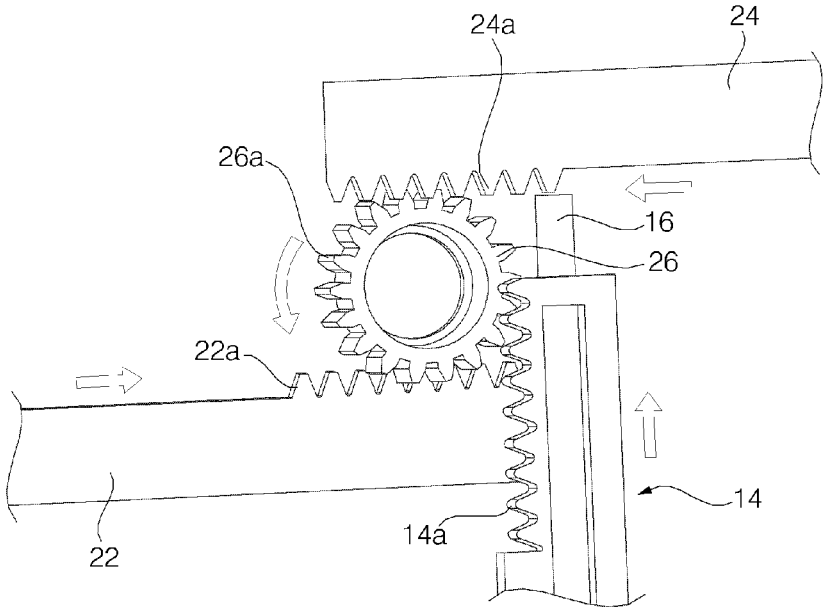
FIG. 3 is a view illustrating a state in which the glove box door is unlocked.

FIG. 1 is a front perspective view illustrating a glove box door of a glove box for a vehicle according to an exemplary embodiment of the present invention, FIG. 2 is a rear perspective view illustrating the glove box door of the glove box for a vehicle according to the exemplary embodiment of the present invention, and FIG. 3 is a view illustrating a state in which the glove box door is unlocked.

Referring to FIGS. 1 to 3, the glove box for a vehicle according to the exemplary embodiment of the present invention includes a glove box door 1 which is disposed in front of a front passenger seat in the vehicle. Here, the glove box door 1 is installed openably and closably in an instrument panel in the interior of the vehicle so as to accommodate articles.

Hinge coupling portions 3 are formed at a lower end of the glove box door 1. The glove box door 1 may be rotatably coupled to a glove box housing (not illustrated) coupled to the instrument panel by inserting a pin (not illustrated) into the hinge coupling portions 3.

The glove box door 1 has an accommodating space 5 formed at a rear side of the glove box door 1 in order to accommodate articles, and when the glove box door 1 is in a closed state, the accommodating space 5 is inserted and disposed in the instrument panel.

A knob device 10 and a locking unit 20, which lock or unlock the glove box door 1 with respect to the glove box housing (not illustrated), are mounted in the glove box door 1.

The knob device 10 includes a knob 12 which is pressed by a user in order to open and close the glove box door 1, and a push rod 14 which is connected with the knob 12 and slidably installed in the glove box door 1. The knob 12 is disposed on a front surface of the glove box door 1, and the push rod 14 is disposed in the glove box door 1. The knob device 10 will be described in detail with reference to FIGS. 4 to 12, and the locking unit 20 will be briefly described.

The locking unit 20 includes a left locking rod 22, a right locking rod 24, and a rotating body 26 which are disposed in the glove box door 1.

When the glove box door 1 is in the closed state, an end of the left locking rod 22 protrudes to the left side of the glove box door 1, and an end of the right locking rod 24 protrudes to the right side of the glove box door 1. Protruding portions of the left locking rod 22 and the right locking rod 24 may be inserted into a structure of the vehicle, and may be caught to prevent the glove box door 1 from being opened. Here, the structure of the vehicle by which the left locking rod 22 and the right locking rod 24 are caught may be the glove box housing (not illustrated) that is installed in the instrument panel so that the glove box door 1 may be inserted into the glove box housing.

The left locking rod 22 is disposed at the lower side of the rotating body 26, the right locking rod 24 is disposed at the upper side of the rotating body 26, and the push rod 14 is disposed at the right side of the rotating body 26. The rotating body 26 is formed in a circular shape, and a plurality of gear teeth 26*a* is formed around the rotating body 26. Gear teeth 22*a*, which engage with the gear teeth 26*a* of the rotating body 26, are formed on an upper surface of the left locking rod 22, a plurality of gear teeth 24*a*, which engages with the gear teeth 26*a* of the rotating body 26, is also formed on a lower surface of the right locking rod 24, and a plurality of gear teeth 14*a*, which engages with the gear teeth 26*a* of the rotating body 26, is also formed on a left surface of the push rod 14. Therefore, when the user presses the knob 12, the push rod 14 slides into the glove box door 1, the rotating body 26 is thereby rotated, and the left locking rod 22 and the right locking rod 24 are inserted into the glove box door 1, such that the glove box door 1 may be unlocked and opened.

Because the rotating body 26 needs to engage with the push rod 14 as well as the left locking rod 22 and the right locking rod 24, the rotating body 26 may have a sufficient thickness.

The push rod 14, the rotating body 26, the left locking rod 22, and the right locking rod 24 all engage using the gear teeth, as described above, such that the user's force for pressing the knob 12 is transmitted to the left locking rod 22 and the right locking rod 24 without loss, thereby improving operational sensitivity.

Hereinafter, the knob device 10 will be described in detail.

Figure 4:
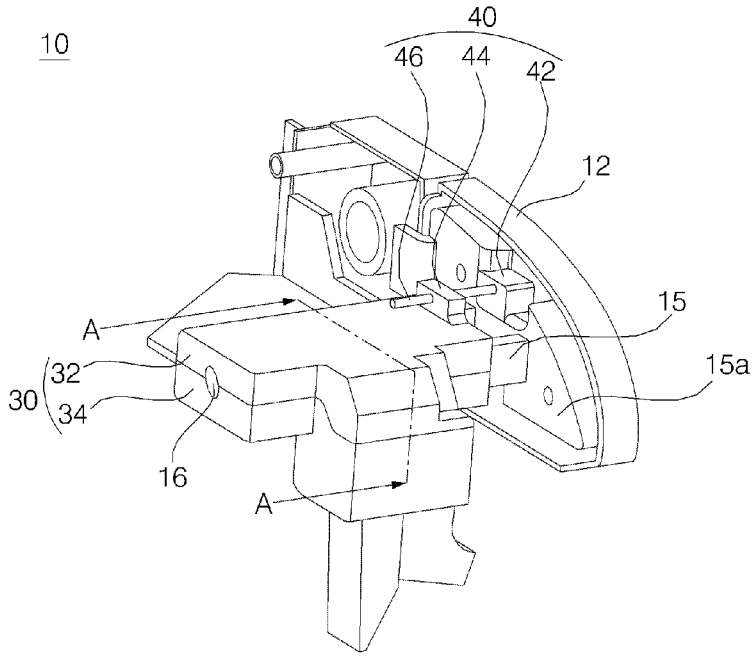
FIG. 4 is a rear perspective view illustrating a knob device illustrated in FIG. 1.
Figure 5:
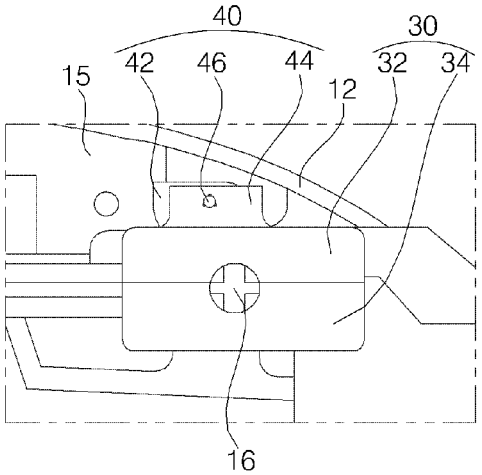
FIG. 5 is a rear view illustrating a part of FIG. 4.
Figure 6:
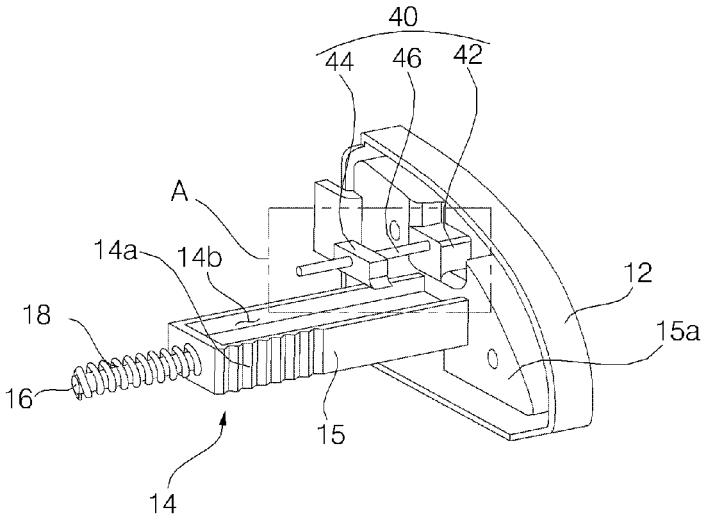
FIG. 6 is a view illustrating the configuration of FIG. 4 except for a push rod housing.
Figure 7:
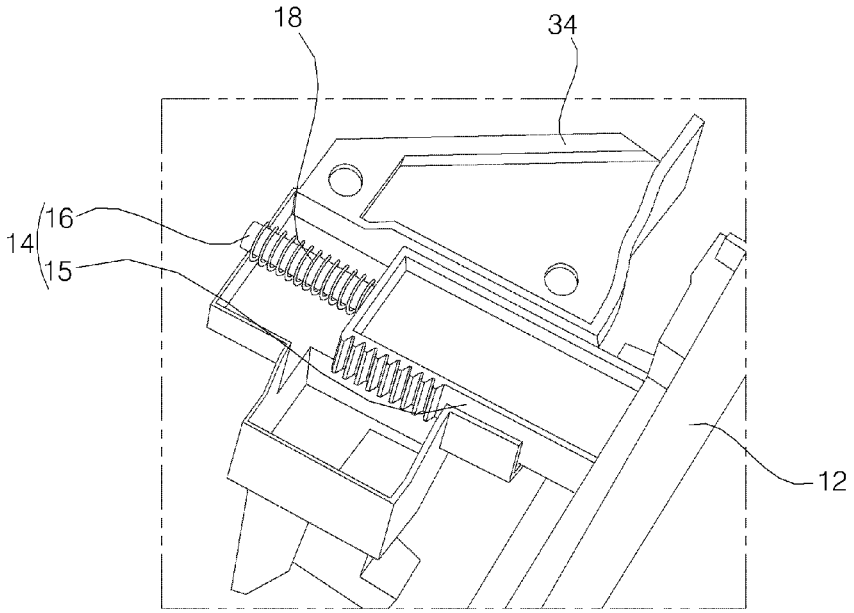
FIG. 7 is a view illustrating the interior of the push rod housing illustrated in FIG. 3.
Figure 8:
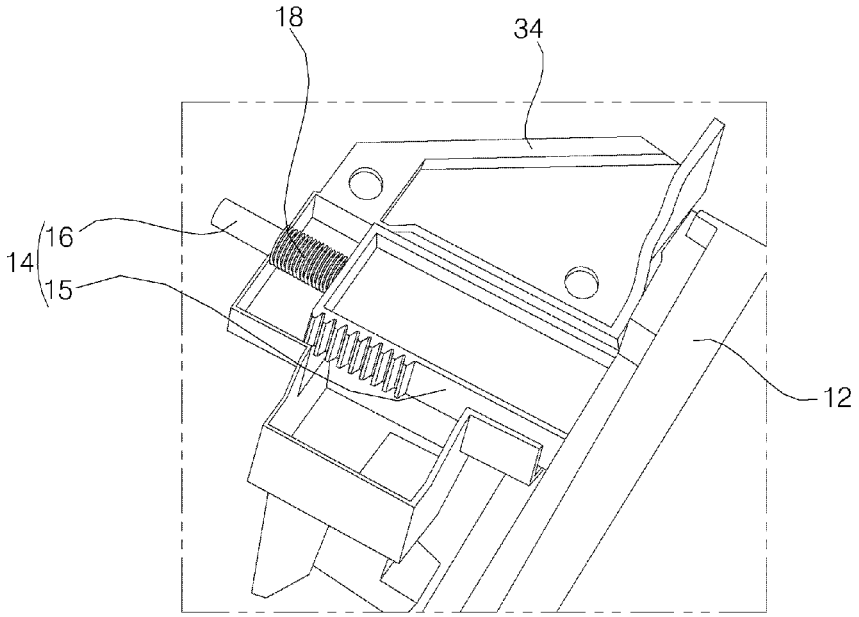
FIG. 8 is an operational view of FIG. 7.
Figure 9:
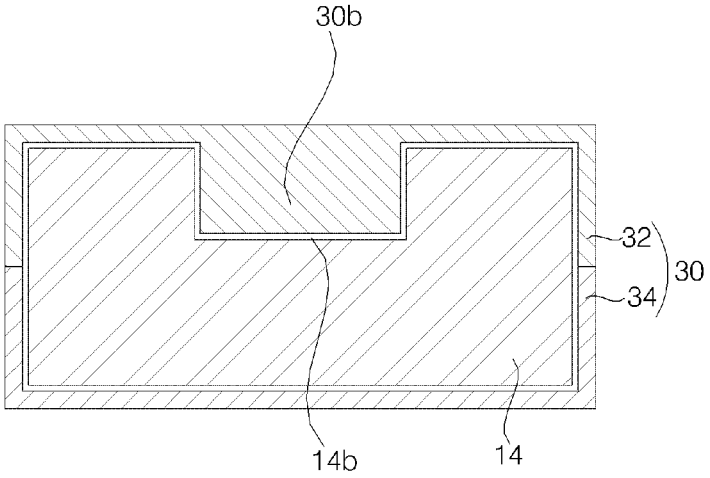
FIG. 9 is a cross-sectional view taken along line A-A of FIG. 4.
Figure 10:
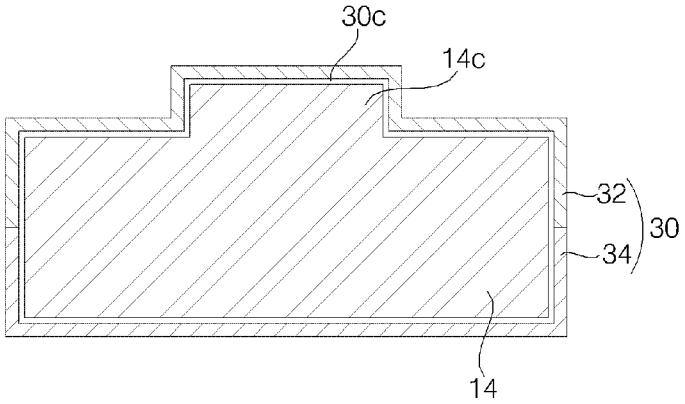
FIG. 10 is a view illustrating another exemplary embodiment of FIG. 9.

FIG. 4 is a rear perspective view illustrating a knob device illustrated in FIG. 1, FIG. 5 is a rear view illustrating a part of FIG. 4, FIG. 6 is a view illustrating the configuration of FIG. 4 except for a push rod housing, FIG. 7 is a view illustrating the interior of the push rod housing illustrated in FIG. 3, FIG. 8 is an operational view of FIG. 7, FIG. 9 is a cross-sectional view taken along line A-A of FIG. 4, and FIG. 10 is a view illustrating another exemplary embodiment of FIG. 9.

Referring to FIGS. 4 to 10, the knob device 10 includes a push rod housing 30 which is fixed to the glove box door 1, the push rod 14 which is slidably disposed in the push rod housing 30, and a guide rod 40 which is coupled to the push rod 14 and moved along an outer surface of the push rod housing 30 when the push rod 14 slides.

When the push rod 14 slides by the user's force for pressing the knob 12, the guide rod 40 is moved along the upper surface of the push rod housing 30 so as to allow the push rod 14 to slide without shaking, thereby improving sensitivity when the user manipulates the knob 12.

The push rod housing 30 includes an upper housing 32, and a lower housing 34 which is coupled to a lower portion of the upper housing 32. The upper housing 32 and the lower housing 34 have therein a vacant space so that the push rod 14 may slide in the space. Therefore, as illustrated in FIG. 7, when the push rod 14 is inserted into the lower housing 34, and thereafter, the upper housing 32 is coupled to the lower housing 34, the push rod 14 may be slidably disposed in the push rod housing 30.

Referring to FIGS. 6 and 9 for a moment, a groove 14*b* is formed in an upper surface of the push rod 14, and a protruding portion 30*b* is formed on an inner surface of the push rod housing 30. The protruding portion 30*b* is inserted and disposed in the groove 14*b*, and as a result, when the push rod 14 slides, the push rod 14 slides without shaking while being guided by the protruding portion 30*b* and the groove 14*b*.

However, referring to FIG. 10, it can be seen that FIG. 10 is different from FIG. 9. That is, on the contrary to FIG. 9, in FIG. 10, a protruding portion 14*c* is formed on the upper surface of the push rod 14, and a groove 30*c* is formed in the inner surface of the push rod housing 30, such that the same effect as the exemplary embodiment illustrated in FIG. 9 may be obtained. Hereinafter, only the exemplary embodiment illustrated in FIG. 9 will be described as an example.

Referring to FIGS. 4 to 8, the push rod 14 includes a first rod portion 15 which has the gear teeth 14*a* formed at a side surface of the first rod portion 15, and is disposed in the push rod housing 30, and a second rod portion 16 which penetrates the push rod housing 30.

A part of the first rod portion 15 is disposed in the push rod housing 30, and the remaining portion of the first rod portion 15 protrudes to the outside from the push rod housing 30 and is coupled to the knob 12.

The first rod portion 15 is formed to have a quadrangular cross section, and the groove 14*b* is formed in the upper surface of the first rod portion 15.

The second rod portion 16 is formed to have a circular cross section, and have a smaller cross-sectional area than the first rod portion 15.

The second rod portion 16 is formed to be elongated at one end of the first rod portion 15, and a coupling portion 15*a*, which is coupled to a back surface of the knob 12, is formed at the other end of the first rod portion 15.

The knob 12 is formed to have a larger area than the coupling portion 15*a* so as to allow the coupling portion 15*a* of the push rod 14 to be invisible from the interior side of the vehicle.

When the user presses the knob 12, and thereby, the push rod 14 slides, the one end of the second rod portion 16 protrudes to the outside from the push rod housing 30, and guides the push rod 14 so that the push rod 14 may slide without shaking.

An elastic member 18 is further disposed in the push rod housing 30. The elastic member 18 is disposed around the second rod portion 16.

When the push rod 14 slides, the elastic member 18 is compressed between the first rod portion 15 and the push rod housing 30. That is, in a state illustrated in FIG. 8 after the user presses the knob 12 in a state illustrated in FIG. 7, the elastic member 18 is compressed and pushes the first rod portion 15, and as a result, the push rod 14 may slide toward an original position.

Figure 11:
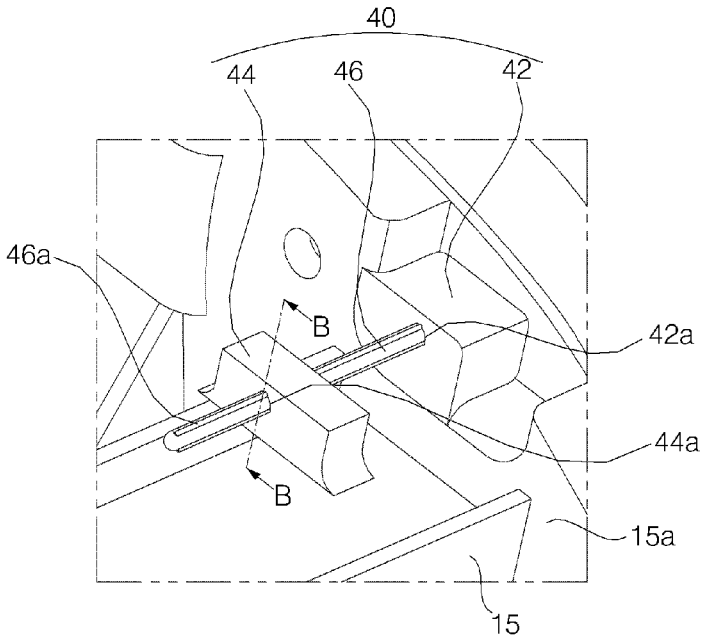
FIG. 11 is a view illustrating part A partitioned by a dotted line in FIG. 6.
Figure 12:
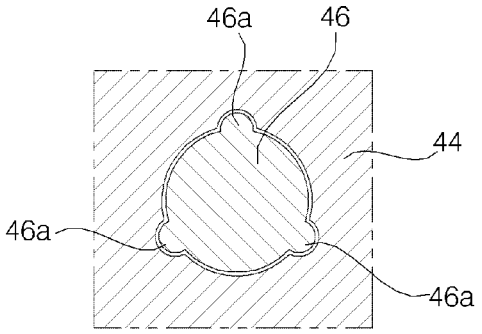
FIG. 12 is a cross-sectional view taken along line B-B of FIG. 11.

FIG. 11 is a view illustrating part A partitioned by a dotted line in FIG. 6, and FIG. 12 is a cross-sectional view taken along line B-B of FIG. 11.

Referring to FIGS. 4, 11, and 12, in a case in which the knob device 10 has a small size, the push rod 14 may slide without shaking by the configuration of the exemplary embodiment illustrated in FIGS. 9 and 10 even though there is no guide rod 40. However, in a case in which the knob device 10 has a large size, it is necessary to additionally assemble the guide rod 40 to the knob device 10 as necessary.

In order to easily assemble the guide rod 40 to the back surface of the knob 12, the guide rod 40 includes a fixing member 42 which is coupled to the push rod 14, a guide member 44 which is spaced apart from the fixing member 42 and movably disposed on the outer surface on the push rod housing 30, and a connecting member 46 which connects the fixing member 42 and the guide member 44.

In the present exemplary embodiment, the fixing member 42 is coupled to the coupling portion 15*a* coupled to the back surface of the knob 12, but the fixing member 42 may be coupled directly to the back surface of the knob 12. The fixing member 42 may be coupled to the coupling portion 15*a* by a screw.

The fixing member 42 and the guide member 44 are formed in a hexahedron shape, and the connecting member 46 is formed in a long bar shape having a circular cross section.

An insertion groove 42*a* into which the connecting member 46 is inserted is formed in the fixing member 42, and a through hole 44*a* through which the connecting member 46 passes is formed in the guide member 44.

The fixing member 42 is first coupled to the coupling portion 15*a*, the connecting member 46 then passes through the through hole 44*a* of the guide member 44, and thereafter, one end of the connecting member 46 is fitted into the insertion groove 42*a* of the fixing member 42, thereby easily assembling the guide rod 40 to the push rod 14.

A rib 46*a* is formed on an outer surface of the connecting member 46. The rib 46*a* is formed to be elongated along a length of the connecting member 46. Three ribs 46*a* are formed around the connecting member 46.

When the guide rod 40 is completely assembled to the push rod 14, the rib 46*a* is caught by the fixing member 42 and the guide member 44, thereby preventing the guide member 44 and the connecting member 46 from being rotated. Therefore, when the user presses the knob 12, and thereby, the push rod 14 slides, the guide member 44 is moved along the upper surface of the push rod housing 30 without being rotated, thereby allowing the push rod 14 to slide without rattling.

An operation of the glove box for a vehicle according to the exemplary embodiment of the present invention, which is configured as described above, will be described below.

First, the case in which the guide rod 40 is not installed, the groove 14*b* is formed in the push rod 14, and the protruding portion 30*b* is formed on the push rod housing 30, as illustrated in FIG. 9, or the case in which the protruding portion 14*c* is formed on the push rod 14, and the groove 30*c* is formed in the push rod housing 30, as illustrated in FIG. 10, will be described below.

When the user presses the knob 12 in order to open the glove box door 1, the push rod 14 slides in the push rod housing 30.

In this case, the push rod 14 slides without shaking while being guided by the protruding portion 30*b* or 14*c*, and the groove 14*b* or 30*c*, thereby improving operational sensitivity when the user presses the knob 12.

Second, the case in which the guide rod 40 is additionally installed in the state illustrated in FIG. 9 or 10 will be described below.

When the user presses the knob 12 in order to open the glove box door 1, the push rod 14 slides in the push rod housing 30, and the guide member 44 of the guide rod 40 slides along the upper surface of the push rod housing 30.

In this case, the push rod 14 slides without rattling while being guided by the protruding portion 30*b* or 14*c*, and the groove 14*b* or 30*c*, and the guide member 44 slides in a state in which the guide member 44 is in contact with the upper surface of the push rod housing 30, such that the push rod 14 slides more stably without rattling, thereby further improving operational sensitivity when the user presses the knob 12.

Third, the case in which the protruding portion 30*b* or 14*c*, and the groove 14*b* or 30*c* are not formed on/in the push rod 14 and the push rod housing 30, but only the guide rod 40 is installed will be described below.

When the user presses the knob 12 in order to open the glove box door 1, the push rod 14 slides in the push rod housing 30, and the guide member 44 of the guide rod 40 slides along the upper surface of the push rod housing 30.

In this case, the push rod 14 may shake, but since the guide member 44 slides in a state in which the guide member 44 is in contact with the upper surface of the push rod housing 30, the push rod 14 does not shake, thereby improving operational sensitivity when the user presses the knob 12.

According to the glove box for a vehicle according to the present invention, when the user presses the knob 12, the push rod 14 slides without shaking, thereby improving operational sensitivity when the user presses the knob 12, and preventing the knob 12 from rattling due to vibration of the vehicle when the vehicle travels.

It may be understood to the person skilled in the art that the present invention may be implemented as other specific forms without changing the technical spirit or the essential characteristics. Thus, it should be appreciated that the exemplary embodiment described above is intended to be illustrative in every sense, and not restrictive. The scope of the present invention is represented by the claims to be described below rather than the detailed description, and it should be interpreted that all the changes or modified forms, which are derived from the meaning of the scope of the claims, the scope of the claims, and the equivalents thereto, are included in the scope of the present invention.

What is claimed is:

1. A glove box for a vehicle, comprising:

a glove box door hinged on an instrument panel of the vehicle to open and close the glove box; and a locking device installed at the glove box door to lock the glove box door to the instrument panel, the locking device including:

a push button provided on a front surface of the glove box door;

a push rod housing fixed to the glove box door at an inside of the glove box door;

a push rod protruded from a rear surface of the push button and slidably disposed in the push rod housing to be coupled with locking rods by a gear such that the locking rods locks or unlocks the glove box door when the push rod slides in the push rod housing by the push button; and a guide rod coupled to the push rod, and movably disposed on and along an outer surface of the push rod housing such that the guide rod moves on and along the outer surface of the push rod housing in a direction when the push rod slides in the direction in the push rod housing by the push button.

2. The glove box of claim 1, wherein the guide rod includes:

a fixing member which is coupled to the push rod;

a guide member which is spaced apart from the fixing member, and movably disposed on the outer surface of the push rod housing; and a connecting member which connects the fixing member and the guide member.

3. The glove box of claim 2, wherein an insertion groove into which the connecting member is inserted is formed in the fixing member, and a through hole through which the connecting member passes is formed in the guide member.

4. The glove box of claim 3, wherein a rib coupled to the fixing member and the guide member is formed on the connecting member.

5. The glove box of claim 1, wherein the push rod includes:

a first rod portion coupled to the rear surface of the push button and having gear teeth formed on a side surface of the first rod portion; and a second rod portion extended from an end of the first rod portion and configured to penetrate the push rod housing.

6. The glove box of claim 5, further comprising:

an elastic member which is disposed around the second rod portion in the push rod housing.

7. The glove box of claim 6, wherein the elastic member is compressed between the first rod portion and the push rod housing when the push rod slides.

8. The glove box of claim 1, further comprising a groove formed on one of an inner surface of the push rod housing and an outer surface of the push rod;

a protruding portion formed on the other one of the inner surface of the push rod housing and the outer surface of the push rod, the protrusion portion being inserted into the groove such that the push rod is guided by the protrusion portion and the groove when the push rod slides in the push rod housing.

9. The glove box of claim 8, wherein the push rod includes:

a first rod portion coupled to the rear surface of the push button and having one of the protruding portion and the groove; and a second rod portion extended from an end of the first rod portion, and penetrates the push rod housing and configured to penetrate the push rod.

10. The glove box of claim 9, wherein gear teeth are further formed on a side surface of the first rod portion.

11. The glove box of claim 9, further comprising:

an elastic member which is disposed around the second rod portion in the push rod housing.

12. The glove box of claim 11, wherein the elastic member is compressed between the first rod portion and the push rod housing when the push rod slides.

* * * * *